United States Patent [19]

Albishausen

[11] 4,073,030

[45] Feb. 14, 1978

[54] SUCTION CLEANING APPARATUS WITH A BAFFLE TO DIRECT FLOW OF A CLEANING FLUID

[76] Inventor: Hartmut Albishausen, Auf den 30 Morgen, 6382 Friedrichsdorf, Germany

[21] Appl. No.: 723,195

[22] Filed: Sept. 14, 1976

[30] Foreign Application Priority Data

Sept. 15, 1975 Austria ..... 7052/75

[51] Int. Cl.[2] ..... A47L 7/00

[52] U.S. Cl. ..... 15/322; 134/21; 134/34

[58] Field of Search ..... 134/6, 21, 34; 15/302, 15/320, 321, 322

[56] References Cited

U.S. PATENT DOCUMENTS

| | | | |
|---|---|---|---|
| 742,880 | 11/1903 | Lotz | 15/322 |
| 2,692,163 | 10/1954 | Geel | 15/320 X |
| 3,616,482 | 11/1971 | Brycki | 15/322 X |
| 3,705,437 | 12/1972 | Rukavina et al. | 15/322 X |
| 3,840,935 | 10/1974 | Fitzgerald et al. | 15/322 |
| 3,942,214 | 3/1976 | Maasberg | 15/320 |

FOREIGN PATENT DOCUMENTS

| | | | |
|---|---|---|---|
| 851,472 | 10/1952 | Germany | 15/322 |

*Primary Examiner*—S. Leon Bashore
*Assistant Examiner*—Marc L. Caroff
*Attorney, Agent, or Firm*—Michael J. Striker

[57] ABSTRACT

A vacuum-type cleaning apparatus and a cleaning method employ a cleaning head which is mounted on a housing and which has an intake opening that is adapted to be juxtaposed with contaminated portions of an object to be cleaned. A suction force is generated and transmitted via a suction channel through the intake opening and thereby to the object. Nozzles inject a stream of cleansing fluid into the channel and its flow is directed towards the intake opening and at an angle relative to the plane of the intake opening so as to impinge the object prior to the removal of the contaminants entrained in the stream from the object by suction. The flow is directed by a baffle which is inclined transversely of the plane of the intake opening, preferably at an acute angle. The baffle is mounted within the channel and provides for a dry cleaning zone to pick up loose contaminant particles prior to contact being made by the stream of cleaning fluid in the wet cleaning zone.

13 Claims, 8 Drawing Figures

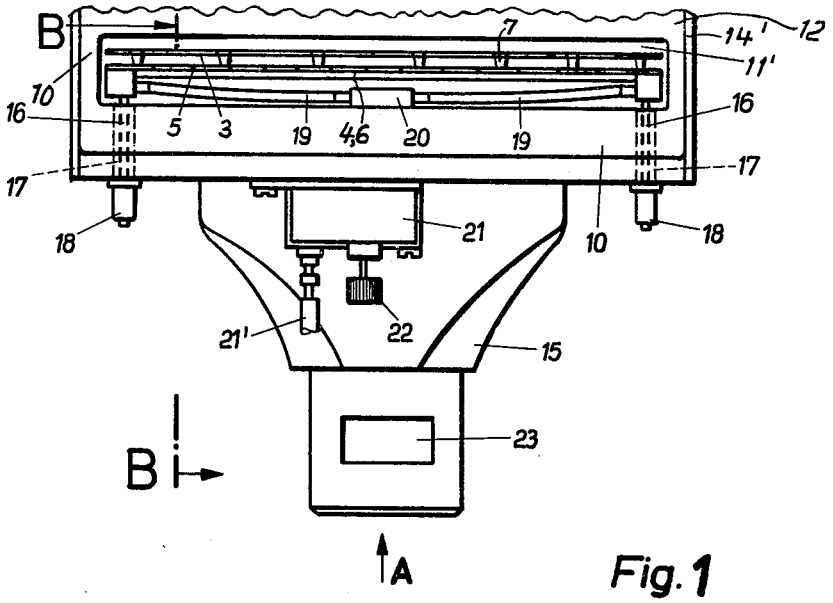
Fig. 1
Fig. 2
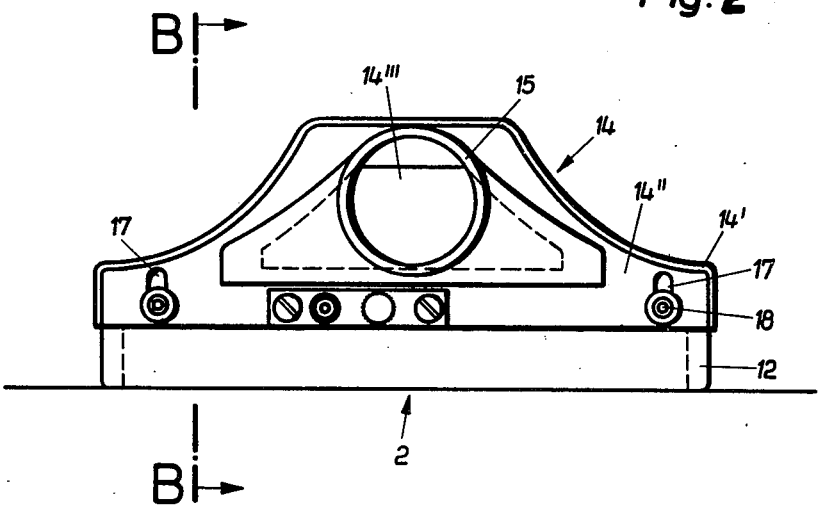

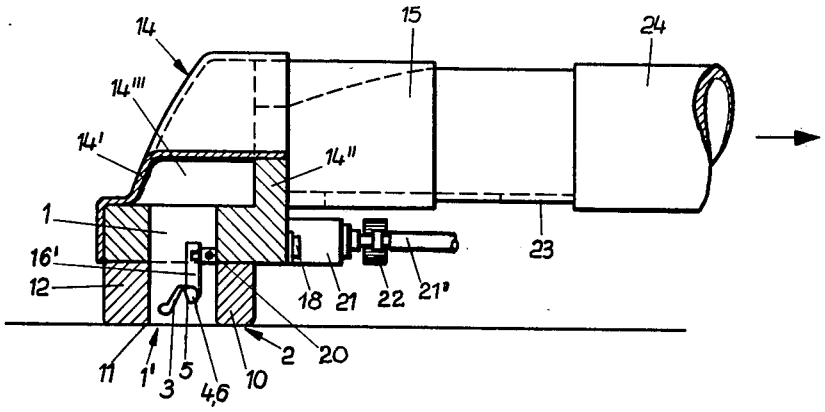
Fig. 3
Fig. 4
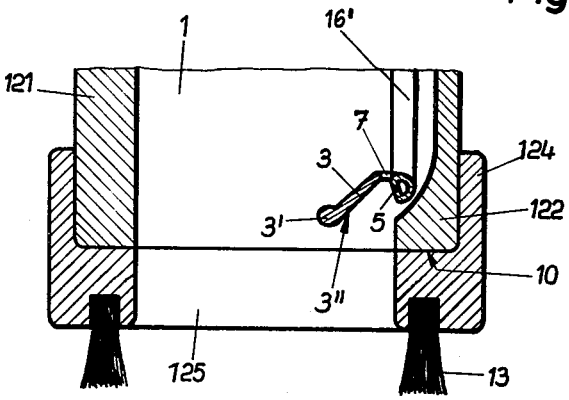

Fig. 5d
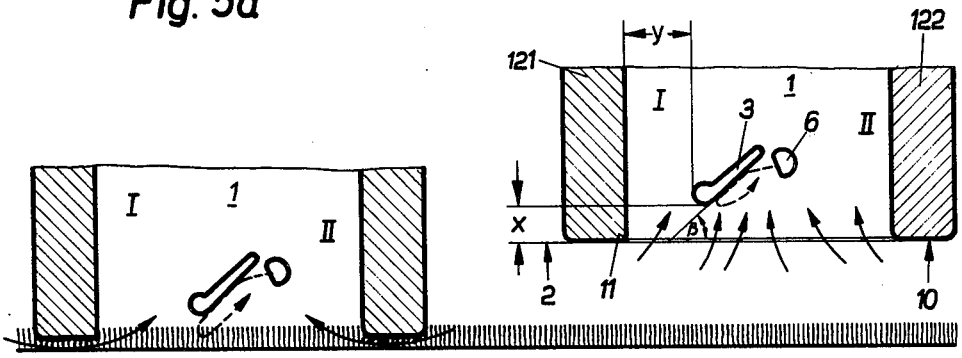
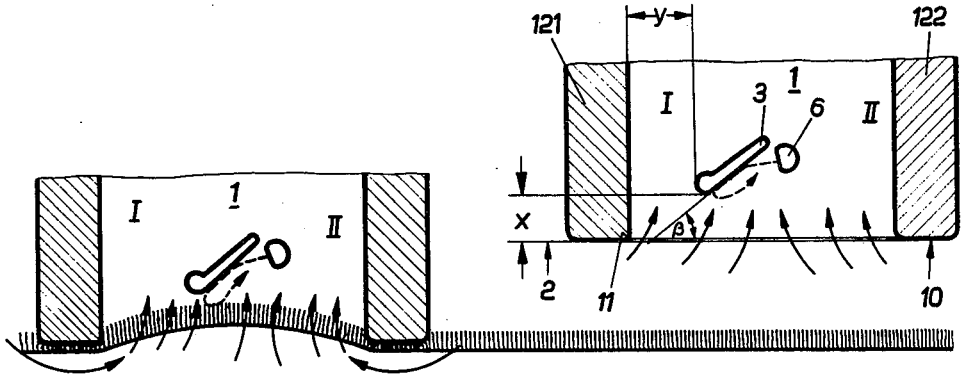
Fig. 5e

SUCTION CLEANING APPARATUS WITH A BAFFLE TO DIRECT FLOW OF A CLEANING FLUID

BACKGROUND OF THE INVENTION

The present invention generally relates to a cleaning apparatus and to a method of cleaning and, more particularly, to vacuum-type cleaners which apply a cleaning fluid containing a liquid component and a detergent component onto the object to be cleaned and subsequently which remove the cleaning fluid together with the entrained contaminants.

Cleaning apparatus are known for cleaning furniture, rugs and analogous textile material objects. Such an apparatus includes a cleaning head having an intake opening which is in communication with a suction channel and which is adapted to be juxtaposed with a contaminant-bearing object to be cleaned, and also includes nozzles which spray a pressurized stream of cleaning fluid directly onto the object. However such apparatus have the disadvantage that the pressurized stream is directed normally through the plane of the intake opening so that the stream actually tends to force the contaminant dirt particles contained in the upper regions of the object even further deeper into the interstices of the base web. The dirt particles thereby tend to become anchored and accumulate in the fabric material, thus making subsequent cleaning operations necessary. Such additional cleaning operations are disadvantageous because they are costly and increase the wear of the fabric by exposing the fabric for longer periods of time to large suction forces which are now required to remove the more deeply embedded dirt and by exposing the fabric to the chemical action of the chemical detergent agents.

The prior art also has the disadvantage that the cleaning liquid is applied to an object to be cleaned at points, or in strips when the cleaning head is moving along the objects, i.e. it is applied non-uniformly. In order to achieve uniform wet cleaning over the whole surface of the objects the cleaning head has to be moved several times over the same area of the object.

The prior art also has the disadvantage that when the cleaning head is to be lifted from a respective contaminated portion of an object or when the cleaning head is applied only partially to an object, the cleaning fluid tends to drip down onto the object through the intake opening. This problem is evidently disadvantageous and has been solved only in the unsatisfactory manner of requiring an operator to repeatedly turn off the supply of cleaning fluid prior to lifting the cleaning head to another location.

Another cleaning head for cleaning surfaces of carpets includes a suction cap connected to a generator of vacuum and also includes a series of nozzles, the outlets of which are of small area and are directed directly on to the surface of the carpet or on to the plane of application of the cleaning head formed by the rim of the suction cap. The nozzles are connected via a supply duct to an aerated fluid reservoir, so that cleaning fluid leaves the outlets only if it is drawn out of them by the subpressure that becomes established in the suction cap. In this way, upon partial application of the cleaning head or with the cleaning head lifted from the carpet loss or dripping of cleaning fluid is avoided. However, disadvantages are that the quantity of fluid that can be emitted by the nozzles per unit of time and hence the depth of penetration of the cleaning fluid into the carpet is limited, and it is practically impossible to work with the cleaning head above the level of fluid in the fluid reservoir, as for example when cleaning curtains, wall coverings or the like. The range of use of the cleaning head is therefore restricted as regards the materials to be cleaned, and the cleaning effect is also limited. The cleaning of an object is strictly limited to the upper surface regions. Deeply embedded dirt cannot be effectively picked up.

SUMMARY OF THE INVENTION

Accordingly it is an object of the present invention to overcome the disadvantage of the prior art.

Another object of the present invention is to provide a cleaning apparatus and a cleaning method which applies cleaning fluid to the objects to be cleaned uniformly and which reliably and effectively removes contaminants including deeply embedded dirt particles from objects such as textile materials.

Another object of the present invention is to prevent dripping of cleaning fluid when the cleaning apparatus is lifted from the object to be cleaned without shutting off the cleaning fluid stream.

In keeping with these objects and others which will become more apparent hereinafter, one feature of the invention resides in mounting a cleaning head on a movable housing. The cleaning head is provided with an intake opening which is adapted to be juxtaposed with contaminated portions of an object to be cleaned. A suction force is generated by a suction-generating unit and is transmitted via a suction channel which extends to the opening through the latter and thereby to the contaminated portions of the object. A stream of cleaning fluid medium is injected into the channel utilizing a plurality of nozzles. The stream is directed, for example by a baffle positioned in the path of the stream at an angle transverse to the plane of the intake opening so as to impinge upon the contaminated portions of the object prior to the removal of the contaminants entrained in the stream from the object by operation of the suction-generating unit.

Both the rate of flow of the cleaning fluid and the magnitude of the suction force are adjustable so that an operating condition is obtained wherein the stream of cleaning fluid continuously penetrates to a certain desired depth into the textile material when the cleaning head contacts the object to be cleaned, and wherein the stream of cleaning fluid is continuously returned back away from the intake opening when the cleaning head is lifted from the object to be cleaned. This feature assures that the stream of cleaning fluid is ejected continuously from the nozzles and is returned continuously back towards the suction-generating unit automatically. An operator no longer has to shut off the cleaning fluid stream during operation. The baffle therefore establishes a uniform so-called water curtain and serves to stabilize and to better control the flow towards and away from the intake opening.

In accordance with another feature of the invention, the baffle is mounted within the suction channel so as to define dry- and wet-cleaning zones. The dry-cleaning zone is essentially that region of the intake opening which relies solely on suction to pick up not anchored particles, whereas the wet cleaning zone is that region of the intake opening which utilizes the suction force to pick up the contaminant-entrained cleaning fluid. The degree of cleaning desired, the nature of the object to be cleaned, the position of the baffle in the suction channel, the rate of flow of the cleaning fluid stream and the magnitude of the suction force are all variables which are adjustable depending upon the particular application.

The suction force in the channel should be adjusted so that undue energy need not be expended by an operator to press down on the portion of the object to be cleaned. The operator thus need only to exert the necessary to-and-fro movement of the cleaning head to utilize the cleaning apparatus.

Still another feature of the invention is the adjustability of the position of the baffle in the suction channel. For most practical applications only an adjustment of the vertical distance of the baffle relative to the plane of the intake opening is necessary. However, the present invention also contemplates the adjustment of the horizontal distance of the baffle relative to the wall portions bounding the intake opening, as well as the adjustment of the angle of inclination of the baffle relative to the aforementioned plane.

Yet another feature is embodied in arranging the nozzles in a linear row so that all of the nozzle openings face the baffle so that the stream impinges on the underside of the baffle at an angle. This feature achieves a continuous water curtain of uniform thickness and also having a laminar flow condition. An especially advantageous construction is obtained if the nozzle openings are all linearly arranged along a flattened section of a thick-walled tubular pipe so that all of the nozzle openings will impinge on the underside of the baffle at an angle. This construction greatly simplifies the interchange of the nozzles with other nozzle arrangements.

To even further facilitate the interchange and maintenance of the component parts of the cleaning apparatus, the tubular pipe containing the nozzle openings and the baffle are interconnected by webs spaced along the respective elongations of the pipe and baffle. Such subassemblies can be interchanged with different ones at will.

An additional feature of the invention resides in providing the baffle with an enlarged, teardrop-shaped free end portion which faces away from the nozzles. This smooth contour facilitates the wrapping around of the cleaning fluid in its path back away from the plane of the intake opening, as well as preventing any possible damage to the object to be cleaned in the event that the material of the object actually enters the intake opening by virtue of the suction force generated thereat.

Another feature of the invention provides for forming the suction channel in a slot-shaped configuration, and providing a shear edge at one side of the slot. This feature permits a squeegee-type action during the to-and-fro movement of the cleaning head for the removal of excess moisture.

It is desirable to form the cleaning head out of any synthetic plastic material; tetrafluoroethylene being especially preferred for its wear resistant and sliding properties.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a bottom plan view of the cleaning apparatus taken in direction from the object to be cleaned;

FIG. 2 is a side view of the cleaning apparatus taken in direction of the arrow A of FIG. 1;

FIG. 3 is a partially sectioned view of the cleaning apparatus taken along the line B—B in FIGS. 1 or 2;

FIG. 4 is an enlarged, partially sectioned view of a detail of FIG. 3 with a brush attachment.

Figure 5A:
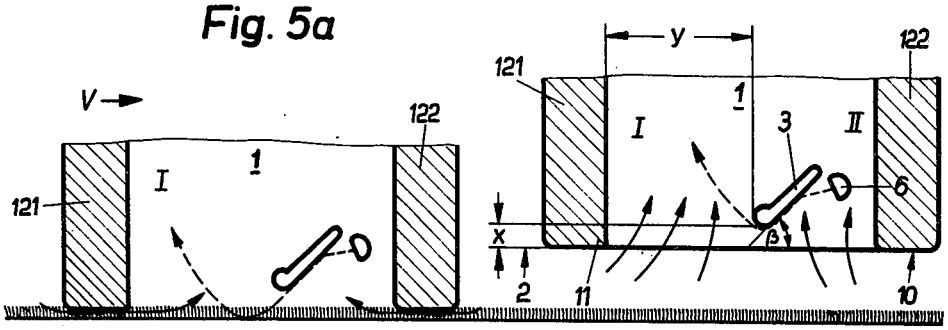
FIGS. 5*a, b, d* and *e* are partially diagrammatic views of preferred embodiments of the invention each depicting the operation of the cleaning apparatus at different operational conditions.

DESCRIPTION OF THE PREFERRED EMBODIMENTS:

Discussing jointly the apparatus and method of the invention with respect to FIGS. 1–3 of the drawing, it will be seen that the cleaning apparatus is comprised of a movable housing having a cleaning head or contact portion 12. The head 12 has an intake opening 1' bounded by wall portions 10 which lie in a plane 2 that is adapted to be juxtaposed with contaminated portions of an object to be cleaned.

The cleaning apparatus also includes a suction-generating unit which comprises an elongated suction channel 1 which extends to the opening 1', a suction hood 14 which overlies the head 12, a conduit 24, and a hollow support attachment 15 which connects the hood 14 to the conduit 24. The hood 14 is formed with an upper part 14' and a lower part 14'' which together bound an interior space 14''' which is in communication with the channel 1 and the interior of the hollow support attachment 15. The suction-generator unit is operative for transmitting suction force generated in the manner which is conventional in the art of vacuum cleaners successively through the intake opening 1', the channel 1, the interior space 14''' of the hood 14, the interior of the attachment 15, and the conduit 24. If desired, the opening 23 formed in the conduit 24 and/or in the attachment 15 can be partially or completely covered, thereby adjusting the magnitude of the suction force.

The channel 1 is preferably formed in the configuration of a slot which extends longitudinally across the width of the apparatus. One boundary wall of the slot-shaped channel 1, specifically the trailing wall as considered with reference to the direction of travel of the cleaning apparatus relative to the object to be cleaned, is formed with a shear edge 11 which facilitates the cleaning effect.

A stream of cleansing fluid medium containing at least a carrier medium and a cleansing component such as detergent agents, disinfectants and the like is injected into the channel 1 preferably near the opening 1' by at least one and preferably a plurality of nozzles 6 which are mounted in the channel 1. Each nozzle 6 has an opening 5 which faces in a preferred embodiment generally towards the plane 2 of opening 1'. All of the nozzles 6 are arranged in a longitudinally-extending row along a tubular pipe 4. At both ends of the pipe 4, connecting tubular members 19 establish communication between the interior of the pipe 4 and the distributing member 20. The distributing member 20 is in turn connected with the control chamber 21 which is in its turn connected to a supply of cleansing fluid medium by the connector 21'. Thus the cleaning fluid medium is conducted, preferably under pressure, through the connector 21', the chamber 21, the distributing member 20, the tubular members 19, and the pipe 4 for eventual discharge as a pressurized stream into the channel 1. Adjusting screw element 22 is operative for setting the amount and pressure of the cleaning fluid medium flow.

This stream is intercepted and directed by the baffle element 3 which is also mounted in the channel 1 at a distance from the nozzles 6. Baffle 3 extends in longitudinal direction across the width of the apparatus, and also is inclined at an angle relative to the plane 2 of the opening 1'. As shown in FIG. 4, the baffle 3 has a deflecting or lower side 3" and an enlarged preferably teardrop-shaped free end 3' which faces away from the nozzles 6. The baffle 3 is operative to cause the stream to be directed in a transverse direction relative to the plane 2 of the opening 1' so as to impinge upon any contaminated portions of an object to be cleaned and dislodge contaminants therefrom.

The relative and/or absolute position of the nozzles 6 or the baffle 3 in the channel 1 may be either independently or simultaneously adjusted. Moreover, the position of the nozzles 6 and the baffle 3 may be permanently locked in position relative to each other. In FIG. 1 the relative position of the baffle 3 relative to the nozzles 6 is fixed due to the fact that webs 7 are provided which interconnect the baffle 3 and the nozzles 6. Thus, the angle of incidence of the stream on the baffle 3 is predetermined in this embodiment.

However, the absolute position of both the baffle 3 and the nozzles 6 relative to the plane 2 is simultaneously adjusted by the provision of the support rods 16 which extend outwardly through slotted holes 17, 17' to the exterior of the housing. The slotting holes 17, 17' extend generally in direction transverse to the plane 2 and permit vertical adjustment as desired relative to the latter by turning the nuts 18 in requisite direction.

In FIG. 3 the support rods 16 are connected via holders 16' to the nozzles 6 being in the form of a nozzle tube.

If it is desired to change the predetermined angle of incidence in this embodiment, the entire interconnected subassembly of nozzles 6, webs 7 and baffle 3 can be interchanged as a unit with another similar assembly which has a different angle of incidence. In the operation of the embodiment of FIGS. 1–3, the respective rates for supplying and withdrawing the cleaning fluid medium are separately adjustable so that proper balancing between the two rates is obtained.

In the operation, i.e. in moving on and in contact with the object to be cleaned the cleaning apparatus connected with a vacuum generator via the conduct 24, e.g. a tubular pipe, and with a source of pressure fluid, e.g. a pump, via the connector 21' may either be held in the hand and guided directly in the region of the attachment 15, which may be formed as a handle, or indirectly via a guide rod arranged in the vicinity of the attachment 15.

FIG. 4 illustrates the lower portion of cleaning head 12 which is comprised of side sections 121 and 122. Brush attachment 124 is placed over the free end of head 12 so that passage 125 is aligned with channel 1. A row of brushes 13, preferably arranged in an annular configuration, is mounted at the underside of attachment 124 in the border region which overlies the wall portions 10. Quick and simple interchange of attachment 124 with other attachments on the head 12 is realized by snap-in and snap-out connection.

Turning now to FIGS. 5*a, b, d* and *e,* it will be seen that the operation of the cleaning apparatus is diagrammatically illustrated with like reference numberals identifying like components. The left side of each Figure shows the operational condition in which the cleaning head 12 comprised of side sections 121 and 122 is placed in direct contact with the object to be cleaned; the right side of each Figure shows the different operational condition in which the cleaning head has been lifted a slight distance from the object. As an aid in understanding all of the Figures, the solid line arrows indicate air flow, whereas the dotted line arrows indicate the flow of the stream of cleaning fluid medium through the apparatus. The direction of travel of the movable housing has been identified by the arrow V. It will be remembered that shear edge 11 which facilitates the cleaning is formed on the trailing side section 121. Furthermore, in each of the Figures, the absolute positions of the baffle 3 and nozzles 6 relative to the plane 2 and the channel 1 are different. Thus reference character $y$ identifies the distance of the enlarged end 3' of the baffle 3 relative to the inner wall of trailing side section 121; reference character $x$ identifies the distance of the enlarged end 3' of the baffle 3 relative to the plane 2; and angle $\beta$ identifies the angle of inclination that the baffle 3 assumes relative to the plane 2. The angle $\beta$ is preferably an acute angle, 45° being the preferred value. The channel 1 is divided into chambers I and II. Chamber I generally identifies the region adjacent the trailing side section 121; and chamber II generally identifies the region adjacent the leading side section 122.

The object to be cleaned in FIG. 5*a* is preferably a low nap or pile rug whose underside is firmly secured, i.e. adhesively to the floor or analogous support. Thus movement of the cleaning head across the rug will not result in appreciable attraction of a respective rug portion into the intake opening. The $x$, $y$, $\beta$ dimensions of the baffle 3 are selected as indicated so that, in the so-called "contact" condition illustrated on the left side of FIG. 5*a,* the continuous stream of cleaning fluid aided by the incoming air flows successively impinges on the baffle, flows along the underside of the baffle, continuously impinges on the rug, penetrates in the nap of the rug wherein it picks up the contaminants, and is finally removed by suction in direction away from the plane 2 towards the area of chamber 1. In the so-called "lifted" condition on the right side of FIG. 5*a,* the force of the incoming air flows forces the flow more closely around the enlarged end 3'. Thus dripping of the cleaning fluid onto the rug is prevented.

By moving the head in the direction of the arrow V, incoming air flowing under leading side section 122 sucks up any contaminants in the rug located immediately ahead of the baffle 3. In other words any dirt particles not anchored in the rug gets initially sucked up into chamber II prior to any contact being made with the cleaning fluid.

This feature greatly facilitates the overall cleaning operation.

Figure 5B:
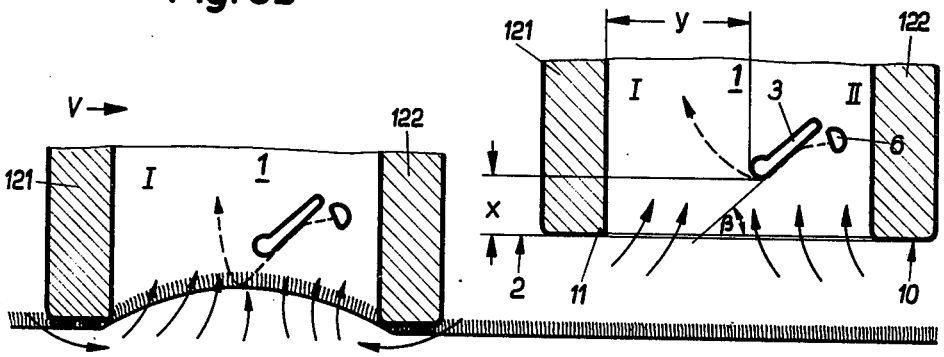

The object to be cleaned in FIG. 5*b* is any air-permeable textile material, preferably a pillow cushion covered with relatively short fibers such as felt, whose underside is not firmly secured to any support. Thus the suction force will attract the respective textile material portion into the intake opening as shown in FIG. 5*b.* The $x$ dimension of the baffle is herein selected to be greater than the corresponding $x$ dimension of FIG. 5*a* in order to accommodate the entry of the respective textile material portion. In this particular application the rounded smooth edge of enlarged portion 3' of the baffle assures that no damaging contact, if any, will be made with the textile material during use. Otherwise the operation depicted in FIG. 5*b* is essentially similar to that described above. However, the intensity of the cleaning effect in the object to be cleaned in FIG. 5*b* is greater in this case because additional air comes from underneath the object and actually penetrates through the foramina of the textile material.

The object to be cleaned in FIG. 5*d* is preferably a high nap or pile rug whose underside is firmly, i.e. adhesively secured to the floor or analogous support. In this embodiment the dimension *y* is chosen to be smaller as compared to the same dimension in FIGS. 5*a* or 5*b*. Thus the incoming air flowing under leading side section 122 is greater than the air flowing under trailing side section 121. This difference in air flow shapes the stream of cleaning fluid so that it now successively impinges on the baffle, flows along the underside of the baffle, continuously impinges on the rug, penetrates the nap, and is finally removed by suction in direction away from the plane 2 towards the area of chamber II. In the lifted position, the incoming air flow forces the cleaning fluid flow more closely toward the nozzles 6. Therefore dripping of the cleaning fluid onto the rug is prevented in this condition.

The arrangement of FIG. 5*d* has a larger dry cleaning zone as compared with the dry cleaning zone of FIGS. 5*a* or 5*b*. This dry cleaning zone comprises substantially the major portions of chambers I and II. Thus the correspondingly much smaller wet-cleaning zone means that the arrangement of FIG. 5*d* is especially well suited for a requirement where only a partial cleaning of the object to be cleaned is required.

The object to be cleaned in FIG. 5*e* is preferably an air-permeable textile material, preferably a pillow cushion covered with relatively long fibers, whose underside is not firmly secured to a support. This illustrated arrangement is especially well suited for a partial cleaning requirement. The dimension *x* is smaller than the corresponding *x* dimension of FIG. 5*b*, but is larger than that of FIG 5*d*. The dimension *y* is also smaller than the corresponding *y* dimension of FIG. 5*b*. As described above in connection with FIG. 5*d*, the cleaning fluid medium flow is directed back towards the nozzle 6 after impingement has been made with the object. The wet cleaning region is again relatively much smaller as compared with its dry cleaning region. The required magnitude of the suction source needed in this arrangement is relatively much less as compared with impermeable fabrics for the reason that additional air enters through the foramina of the textile material itself.

It will be understood that each of the elements described above, or two or more together, may also find a useful application in other types of constructions differing from the types described above.

While the invention has been illustrated and described as embodied in a cleaning apparatus and method of cleaning, it is not intended to be limited to the details shown since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In an arrangement for cleaning planar and curved surfaces of textile material coverings on floors, walls, furniture and the like, of the type having a suction means and a cleaning fluid supply means, a combination comprising a portable cleaning head including a suction attachment connected to the suction means, an elongated intake opening lying in a plane and being juxtaposed with contaminated portions of a surface to be cleaned, and a suction channel extending intermediate said suction attachment and said intake opening for transmitting suction force from the suction means to the surface to be cleaned; means for injecting streams of cleaning fluid along paths into said suction channel at a predetermined acute angle of inclination relative to the plane of said intake opening, including a plurality of fluid discharge outlets in said suction channel, said outlets communicating with the cleaning fluid supply means and being spaced along a row which extends generally along the elongation of said intake opening; and means for directing a fluid curtain constituted by the respective streams towards said intake opening at a predetermined cleaning angle relative to the plane of said intake opening, including a baffle in said suction channel, said baffle being spaced from said outlets and extending generally along the row of said outlets, said baffle having a fluid-deflecting substantially planar portion which is located in the paths of the respective streams and which is inclined at said predetermined cleaning angle which is different from said predetermined angle of inclination of said streams for intercepting the respective streams and for directing the latter to flow for a distance along said substantially planar portion prior to impingement upon the surface to be cleaned, said baffle also having an enlarged rounded portion which extends in an arcuate path from said substantially planar portion and into said suction channel in direction away from the plane of said intake opening, said enlarged rounded portion being sufficiently rounded to direct the intercepted streams to flow at least in part along said arcuate path towards said suction attachment so as to prevent fluid from undesirably dripping onto the surface to be cleaned when said cleaning head is lifted therefrom.

2. A cleaning apparatus as defined in claim 1, wherein said baffle is inclined transversely of the plane of said intake opening and includes an acute angle therewith.

3. A cleaning apparatus as defined in claim 1, wherein said baffle is spaced at a distance from said plane, and wherein adjusting means is included for adjusting the distance of said baffle in said channel relative to the plane of said intake opening.

4. A cleaning apparatus as defined in claim 3, wherein said adjusting means is operative for adjusting the distance of said baffle relative to said plane only in direction substantially normally of the latter.

5. A cleaning apparatus as defined in claim 1, wherein said plurality of outlets are arranged along the elongation of an elongated pipe, and wherein said outlets are inclined at an angle other than zero relative to said baffle.

6. A cleaning apparatus as defined in claim 5, wherein said pipe has a flattened side wall on which said outlets are located.

7. A cleaning apparatus as defined in claim 1; and further comprising means for interconnecting said injecting means and said baffle so that said injecting means and baffle form a replaceable unit.

8. A cleaning apparatus as defined in claim 7, wherein said unit is spaced at a distance from said plane, and wherein said adjusting means adjusts the distance of said unit relative to said plane in direction substantially normally of the latter.

9. A cleaning apparatus as defined in claim 1, wherein said enlarged portion is of teardrop-shaped configuration and extends in direction away from said injecting means.

10. A cleaning apparatus as defined in claim 1, wherein said suction channel is of slot-shaped configuration.

11. A cleaning apparatus as defined in claim 10, wherein said slot-shaped channel has side walls, one of said walls being formed with a shear edge.

12. A cleaning apparatus as defined in claim 1; and further comprising an accessory brush component mounted on said cleaning head.

13. A cleaning apparatus as defined in claim 1, wherein said cleaning head is constituted of tetrafluoroethylene.

* * * * *